US006997021B2

(12) United States Patent
Boni

(10) Patent No.: US 6,997,021 B2
(45) Date of Patent: Feb. 14, 2006

(54) ADJUSTABLE LOCKING STRAP

(76) Inventor: Christopher Boni, 56 Amherst Pl., Livingston, NJ (US) 07039

( * ) Notice: Subject to any disclaimer, the term of this patent is extended or adjusted under 35 U.S.C. 154(b) by 0 days.

(21) Appl. No.: 10/002,941

(22) Filed: Nov. 15, 2001

(65) Prior Publication Data

US 2003/0089140 A1 May 15, 2003

(51) Int. Cl.
*E05B 73/00* (2006.01)

(52) U.S. Cl. ..... 70/18; 70/57; 70/58

(58) Field of Classification Search ..... 70/18, 70/14, 57, 58, 60, 62, 16, 17
See application file for complete search history.

(56) References Cited

U.S. PATENT DOCUMENTS

| | | | | |
|---|---|---|---|---|
| 4,340,376 A | | 7/1982 | Williams | 441/74 |
| 4,366,605 A | | 1/1983 | McKenney | 24/230.5 R |
| 4,402,442 A | | 9/1983 | Martino | 224/324 |
| 4,526,125 A | | 7/1985 | Bain, Jr. | 114/347 |
| 4,527,827 A | | 7/1985 | Maniscalco et al. | 296/3 |
| 4,630,990 A | | 12/1986 | Whiting | 414/462 |
| 4,724,989 A | | 2/1988 | Silberberg | 224/202 |
| 4,765,521 A | | 8/1988 | Finnegan | 224/315 |
| 4,795,178 A | | 1/1989 | Nabarrete | 280/47.13 |
| 4,896,519 A | * | 1/1990 | Pitts | 70/58 |
| 4,957,400 A | | 9/1990 | Karp | 410/110 |
| 5,052,605 A | | 10/1991 | Johansson | 224/324 |
| 5,067,644 A | | 11/1991 | Coleman | 224/324 |
| 5,088,158 A | | 2/1992 | Burkholder | 24/16 |
| 5,095,722 A | | 3/1992 | Chapmond et al. | 70/18 |
| 5,115,955 A | | 5/1992 | Dallaire et al. | 224/324 |
| 5,118,018 A | | 6/1992 | Baldeck | 224/42.03 |
| 5,146,874 A | * | 9/1992 | Vidal | 119/868 |
| 5,159,728 A | | 11/1992 | Bingold | 24/16 |
| 5,263,592 A | * | 11/1993 | Dingee, Jr. | 211/64 |
| 5,582,044 A | | 12/1996 | Bolich | 70/58 |
| 5,695,101 A | | 12/1997 | Frietze | 224/250 |
| 5,706,680 A | | 1/1998 | Wroble | 70/18 |
| 5,738,258 A | | 4/1998 | Farrow et al. | 224/324 |
| 5,769,291 A | | 6/1998 | Chasan | 224/324 |
| 5,802,675 A | | 9/1998 | Parsons | 24/16 |
| 5,802,888 A | | 9/1998 | Parsons | 70/16 |
| 5,832,754 A | | 11/1998 | McKenzie | 70/58 |
| 5,873,505 A | * | 2/1999 | Sovitski | 224/576 |
| 5,956,979 A | * | 9/1999 | Collins et al. | 70/18 |

(Continued)

FOREIGN PATENT DOCUMENTS

DE 3103783 A1 9/1982

*Primary Examiner*—John B. Walsh
(74) *Attorney, Agent, or Firm*—McCarter & English, LLP

(57) ABSTRACT

An adjustable locking strap includes a first loop, a second loop, and an adjustable strap extending therebetween. The second loop can be adjustable in size. The first loop can be fit about a first end of the elongate object, and the second loop can be positioned about a second end of the elongate object and adjusted for proper size. The strap extending between the loops can be adjusted between the loops so that when the first and second loops are positioned about the elongate object, the strap is sized to prevent either loop from being removed from the object. A lock is interconnected with the adjustable loop and strap for securing the size of the adjustable loop and strap. A tether portion can secure the locking strap to a fixed object. A stopper on the tether can be positioned within a car, and the window rolled up to retain the locking strap within a car. A storage bag can be interconnected with the strap for convenient storage thereof.

30 Claims, 3 Drawing Sheets

U.S. PATENT DOCUMENTS 6,003,348 A 12/1999 McCrea ..... 70/18
6,006,555 A 12/1999 Shu-Fen ..... 70/18
6,082,154 A * 7/2000 MacDonald ..... 70/18
6,101,682 A 8/2000 Parsons ..... 24/16
6,151,761 A 11/2000 Thompson ..... 24/16
6,219,887 B1 4/2001 Parsons ..... 24/16
6,263,709 B1 * 7/2001 Kemery et al. ..... 70/14
6,374,645 B1 * 4/2002 Fontes et al. ..... 70/18
6,457,619 B1 10/2002 Werner et al. ..... 224/405
6,539,589 B2 4/2003 Thompson ..... 24/16
6,561,398 B1 5/2003 Cole et al. ..... 224/324
6,616,107 B1 9/2003 Hargreaves ..... 248/68.1
2001/0031588 A1 10/2001 Young ..... 441/74
2002/0178766 A1 * 12/2002 Jackson et al. ..... 70/18

* cited by examiner

ADJUSTABLE LOCKING STRAP

BACKGROUND OF THE INVENTION

1. Field of the Invention

The present invention relates to an adjustable locking strap for attachment to elongate objects such as a surfboards or the like to protect against the theft thereof.

2. Related Art

Various locking devices have been developed in the past for locking personal belongings to guard against theft. Among the most well-known types of locks is a bicycle lock which includes a chain or cable having fixed loops at each end. The cable can be extended through the bicycle frame, about a fixed object such as a fence or pole and then the ends can be secured together by means of a lock such as a combination lock or key lock. However, such locks are insufficient to protect items lacking a space therein for inserting a cable therethrough. A surfboard is such an object that does not have any space or opening to thread a cable through.

Past efforts to provide locks for surfboards and the like include attempts to provide adjustable loops for fitting about a surfboard wherein the loop is specifically sized to be secured between the fins and the wider area of the board. However, this is a very inflexible approach and does not allow one to use the lock interchangeably with different size surfboards. Another approach is to provide a device with a plurality of locks, one lock for interconnecting two loops together about an elongate object and another lock for securing a loop through one of the two loops and about a stationary body. However, this is a cumbersome approach. Other efforts include attaching hardware to a surfboard to allow for a lock to be attached to the surfboard. However, such an approach could be damaging to the surfboard. Other efforts disclose one or two adjustable loops, but do not allow for the locked object to be connected to a fixed object such as a car.

Accordingly, what is needed, but has not heretofore been provided, is an easily adjustable device for locking surfboards and the like which does not damage the object which is being locked, and which allows for the object to be secured to a fixed object.

OBJECTS AND SUMMARY OF THE INVENTION

It is an object of the present invention to provide an easily adjustable device for locking surfboards and other elongate objects.

It is another object of the present invention to provide a lock for elongate objects that have no space for receiving a conventional cable lock.

It is a further object of the present invention to provide an adjustable locking strap for surfboards and the like which is easily adjustable for locking objects of various sizes.

These and other objects of the present invention are achieved by an adjustable locking strap which includes a first loop, a second loop, and an adjustable strap extending therebetween. The first loop can be fit about a first end of the elongate object, and the second loop can be positioned about a second end of the elongate object. The second loop may be adjustable for proper size. The strap extending between the loops can similarly be adjusted between the loops so that when the first and second loops are positioned about the elongate object, the strap is sized to prevent either loop from being removed from the object. A lock is interconnected with one of the loops and the strap for securing the size of the adjustable strap. A tether portion can secure the locking strap to a fixed object. A stopper on the tether can be positioned within a car, and the window rolled up to retain the locking strap within a car. A storage bag can be interconnected with the strap for convenient storage thereof.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to an adjustable locking strap for use in locking elongate objects, such as surfboards and the like, to prevent the theft thereof. The adjustable locking strap includes first and second loops interconnected by an adjustable strap. One of the loops may be adjustable. The loops extend about ends of the elongate object. The loops are connected together by the adjustable strap which is sized such that the loops cannot be removed from the elongate objects. A tether is provided to lock the locking strap and the elongated object to a fixed object.

Figure 1:
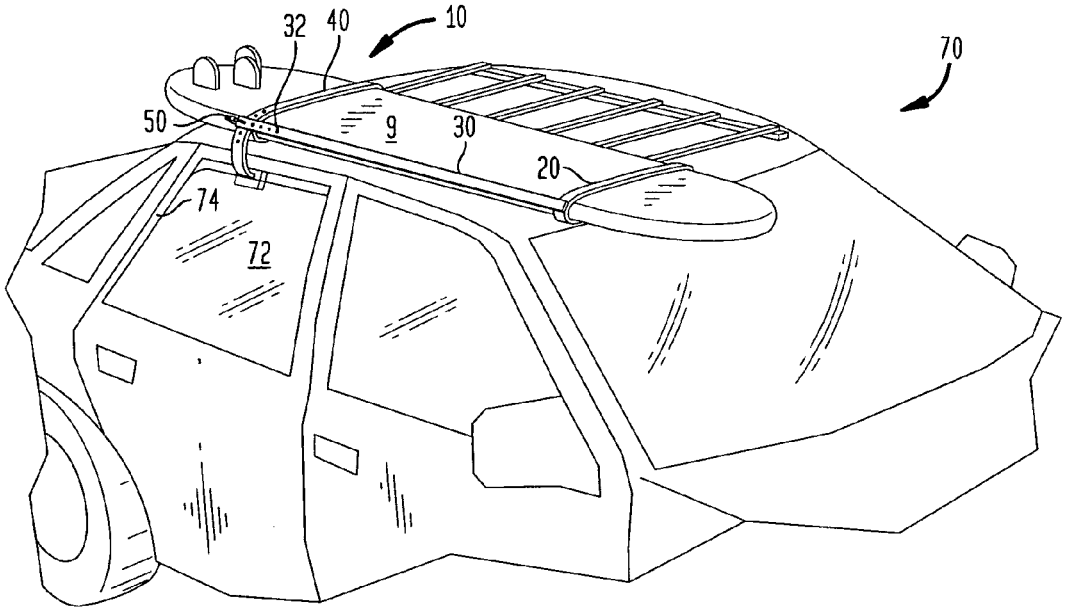
FIG. 1 is a perspective view of the adjustable locking strap of the present invention positioned about a surfboard on a car and locked thereto.
Figure 2:
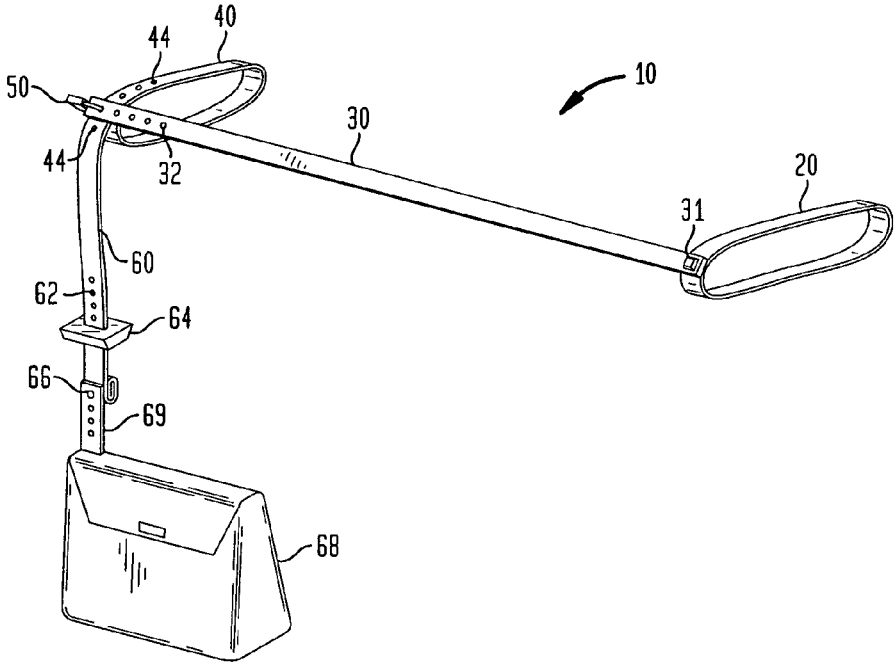
FIG. 2 is a perspective view of the locking strap shown in FIG. 1.
Figure 3:
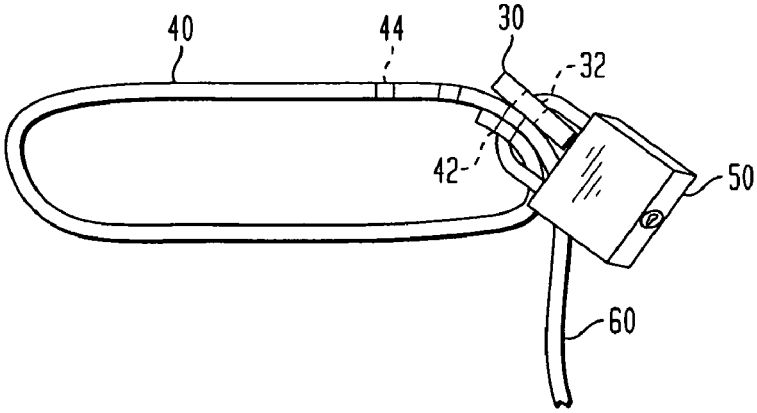
FIG. 3 is a partial side view of the strap shown in FIG. 1.
Figure 5:
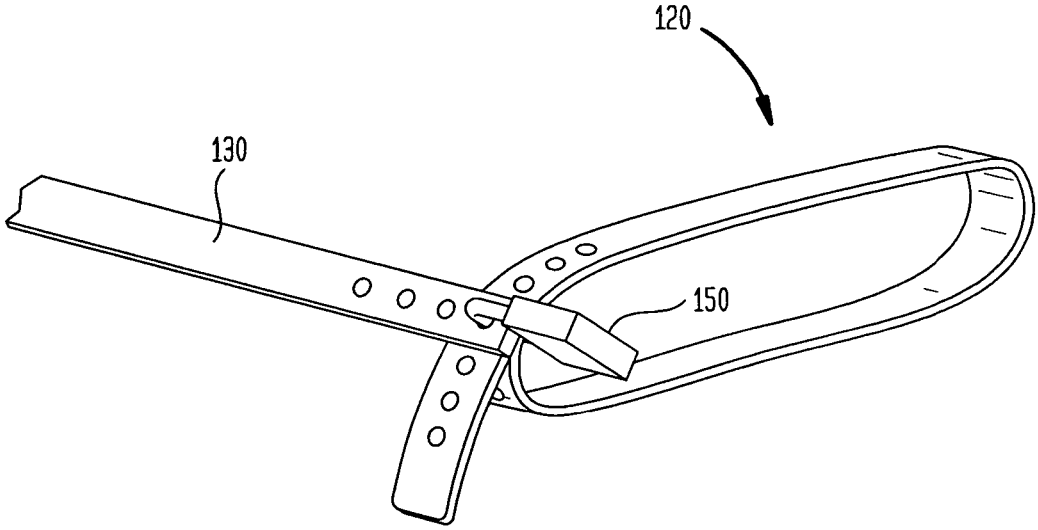
FIG. 5 is a perspective view showing the adjustable loop of the locking strap of the present invention in greater detail.

As shown in FIGS. 1–3, the adjustable locking strap of the present invention, generally indicated at 10, includes a first loop 20 which can be a fixed size or can be adjustable in size. See FIG. 5 which shows loop 120 adjustable in size by means of a lock 150 extending through apertures in strap 130 and loop 120. Loop 20 can be positioned about one end of an elongated object such as a surfboard 9, and is sized to fit about an end of the object but is not large enough to slide over the central portion of the object. A first end of strap 30 is interconnected with the loop 20 in any means known in the art, for example, by stitching 31 for securing the strap 30 to loop 20. The strap 30 may include a plurality of apertures 32 along the second end thereof.

A second loop generally indicated at 40 is attachable to the second end of strap 30. The second loop may be adjustable in size and may include an aperture 42 at a first end and a plurality of apertures 44 along the second end thereof. Aperture 42 can be aligned with one of apertures 44, and both can be aligned with one of the apertures 32 of strap 30. Lock 50 can be extended through the apertures 42, 44 and 32 to form the loop 40 of a desired size and to position it at a desired position along the length of strap 30 so that both loops are positioned about surfboard 9.

The excess length of loop 40 forms a tether 60 which can be used to lock the adjustable locking strap 10 to a stationary object. The tether 60 could also be formed of an excess length of strap 30 or could be a separate member attachable to the strap or loop or both. Stopper 64 can be interconnected with the end of tether strap 60. Alternatively, or additionally, a plurality of apertures 62 can be provided along the tether strap 60 to permit the tether to be looped back on itself and locked by lock 50 to form a loop for extending about a fixed object for locking the lock and the elongate object thereto.

Figure 4:
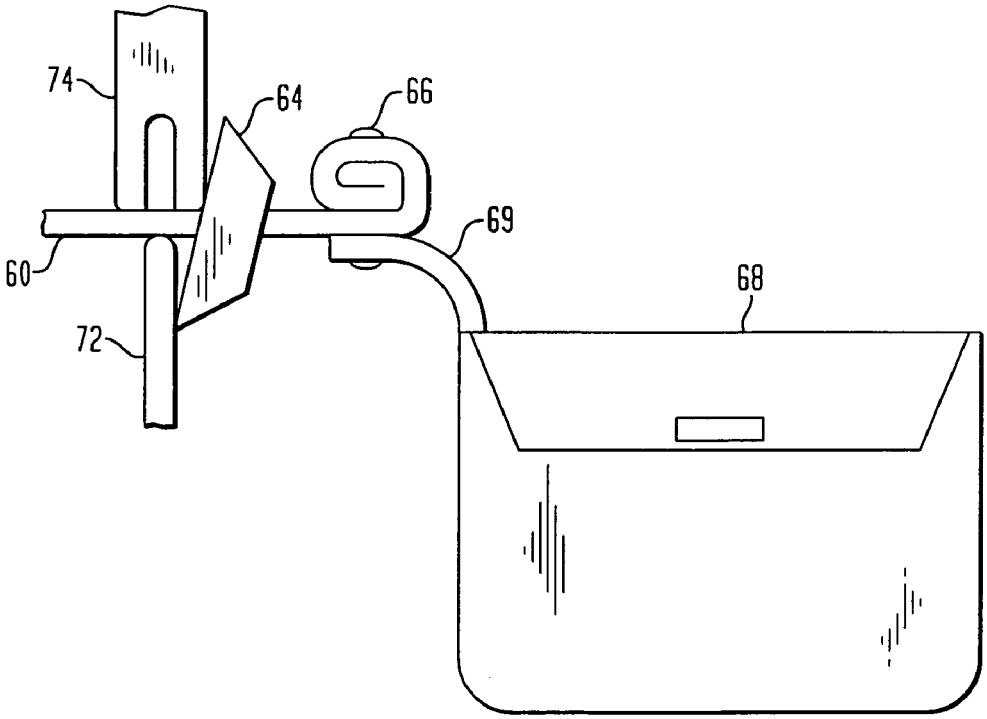
FIG. 4 is a partial side view of the locking strap shown in FIG. 1 with the stopper device positioned within a car.

As shown in detail in FIG. 4, tether strap 60 can be positioned to extend within a vehicle 70 as defined by window 72 and frame 74. When the window 72 is closed the stopper 64 is retained within the vehicle 70 to effectively lock the locking strap 10 and the elongate object to the vehicle 70. The stopper 64 can be retained on the tether 60 by means of a rivet 66. Further, a storage bag 68 can be interconnected by strap 69 to the rivet 66 and to the tether 60. The storage bag can 68 be used for storing the adjustable locking strap 10 when not in use.

The adjustable locking strap invention provides a simple affordable and effective device for locking a surfboard. The straps used in the adjustable locking strap invention can be made from reinforced nylon, or similar material, or other material known in the art. The loops 20 and 40 can be fixed in size to pass over the end of a surfboard, but not past the widest part of the board. Alternatively, one or both of the loops 20 and 40 can be adjustable. The strap 30 can be interconnected with loop 20 in any way known in the art. One preferred way would be by heavy duty permanent stitching. Generally, the strap 30 will extend for about 36 to 60 inches to the second loop 40, though this distance can vary depending on the size of the elongate object being locked. The strap 30 can be interconnected with second loop 40 at a desired point by means of heavy duty commercial stitching. Alternatively, the interconnection of the strap 30 and loop 40 can be adjustable along the length of strap 30 by interconnecting loop 40 with one of apertures 32 along strap 30 at a desired position as shown in the FIGS. Lock 50 can be a standard padlock or combination lock. The window stopper can be affixed on the tether strap 60 or can include an aperture and ride on tether 60. Preferably, the stopper is made of rubber or other non-malleable material as is known in the art. The pouch 68 can be formed of nylon or any other desired material and can use a zipper means or hook and pile type fastening means for closure thereof if desired. Importantly, the tether strap 60 could be part of loop 40, strap 30 or could be a separate element connectable to strap 30 and loop 40 by means of lock 50 passing through an aperture thereof.

In another embodiment of the invention, a single loop can be positioned about between the fins and wide central portion of the board. The size of the loop can be fixed by a lock. A tether strap connected to the loop can be secured about a fixed object to lock the elongate object. A stopper can be interconnected with the tether and positioned within a car window so that when the window is raised, the stopper cannot be removed, and the elongate object is locked to a car.

Having thus described the invention in detail, it is to be understood that the foregoing description is not intended to limit the spirit and scope thereof. What is desired to be protected by Letters Patent is set forth in the appended claims.

What is claimed is:

1. A locking device for an elongate object comprising:

a strap having first and second ends;

a first loop at the first end of the strap for encircling a first end of an elongate object;

a second loop interconnectable at one of a plurality of locations along the second end of the strap, the second loop being adjustable in size for encircling a second end of an elongate object; and a lock for interconnecting the second loop at the one of the plurality of locations of the second end of the strap and for locking the size of the second loop.

2. The device of claim 1 further comprising a tether extending from the locking device for attaching an elongate object to a fixed object.

3. The device of claim 2 wherein the tether includes a stopper interconnected therewith for positioning within a car window for attaching the strap and an elongate object to a car.

4. The device of claim 3 further including a pouch interconnected with the tether for storing the locking device when not in use.

5. A locking apparatus for an elongate object comprising:

a first loop positionable about a first end of an elongate object;

a second loop positionable about a second end of an elongate object;

a strap adjustable in size for connecting the first and second loops;

a tether interconnected with the strap for attachment to a fixed object; and a lock for locking the apparatus.

6. The apparatus of claim 5 wherein one of the first or second loops is adjustable in size.

7. The apparatus of claim 6 wherein the size of the adjustable loop is fixed by the lock.

8. The apparatus of claim 5 wherein a stopper is attached to the tether for connecting the locking apparatus to a vehicle.

9. The apparatus of claim 8 wherein a storage bag is connected to the tether.

10. The apparatus of claim 5 wherein the size of the strap is fixed by the lock.

11. The apparatus of claim 5 wherein the tether extends from one of the loops.

12. The apparatus of claim 5 wherein the tether extends from the strap.

13. A method of locking an elongate object comprising:

positioning a first loop about a first end of an elongate object;

positioning a second loop about a second end of an elongate object;

securing a strap between the first and second loops;

locking the strap to one of the loops;

providing a tether attached to the strap;

providing a stopper on the tether; and securing the tether to a fixed object by extending the tether through an open car window to position the stopper within the car and raising the window to secure the stopper within the car to fix an elongate object to a car.

14. The method of claim 13 wherein a storage bag is interconnected with the tether and the method further includes storing the loops and strap within the storage bag when not in use.

15. A locking apparatus for a surfboard comprising:

an adjustable loop formed of a flexible material for extending about a surfboard positioned between fins extending from the surfboard and a wide middle portion of the surfboard;

a lock for fixing the size of the adjustable loop;

a tether strap interconnected with the adjustable loop; and a stopper interconnected with the tether strap, the stopper rides on the tether and a rivet at the end of the tether retains the stopper on the tether;

whereby, the stopper is positionable within a car window and the window can be raised against the tether strap to retain the stopper within the vehicle to lock the surfboard to a car.

16. The locking apparatus of claim 15 wherein the tether strap is formed of an excess length of the flexible material that forms the adjustable loop.

17. A locking apparatus for a surfboard comprising:

an adjustable loop formed of a flexible material for extending about a surfboard positioned between fins extending from the surfboard and a wide middle portion of the surfboard;

a lock for fixing the size of the adjustable loop;

a tether strap interconnected with the adjustable loop, the tether strap formed of an excess length of the flexible material that forms the adjustable loop; and a stopper interconnected with the tether strap;

whereby, the stopper is positionable within a car window and the window can be raised against the tether strap to retain the stopper within the vehicle to lock the surfboard to a car.

18. The apparatus of claim 17 wherein the stopper rides on the tether and a rivet at the end of the tether retains the stopper on the tether.

19. A locking apparatus for a surfboard comprising:

an adjustable loop formed of a material flexible along its entire length for extending about a surfboard, the loop positioned between fins extending from the surfboard and a wide middle portion of the surfboard;

a lock for fixing the size of the adjustable loop;

a tether strap interconnected with the adjustable loop; and a stopper interconnected with the tether strap;

wherein the stopper rides on the tether and a rivet at the end of the tether retains the stopper on the tether.

20. The locking apparatus of claim 19 wherein the tether strap is formed of an excess length of the flexible material that forms the adjustable loop.

21. A locking apparatus for an elongate object comprising:

a first loop positionable about a first end of an elongate object;

a second loop positionable about a second end of an elongate object, one of the first or second loops adjustable in size;

a strap adjustable in size for connecting the first and second loops;

a tether interconnected with the strap, the tether extending from one of the loops, for attachment to a fixed object; and a lock for locking the apparatus.

22. The apparatus of claim 21 wherein the size of the adjustable loop is fixed by the lock.

23. The apparatus of claim 21 wherein the size of the strap is fixed by the lock.

24. The apparatus of claim 21 wherein the tether extends from the strap.

25. The apparatus of claim 21 wherein a stopper is attached to the tether for connecting the locking apparatus to a vehicle.

26. The apparatus of claim 25 wherein a storage bag is connected to the tether.

27. A method of locking an elongate object comprising:

positioning a first loop about a first end of an elongate object;

positioning a second loop about a second end of an elongate object;

securing a strap between the first and second loops;

locking the strap to one of the loops;

providing a tether attached to the strap; and securing the tether to a fixed object by extending the tether about a fixed object and locking an end of the tether to the strap.

28. The method of claim 27 wherein the tether is locked to the strap at the location where the strap is locked to one of the loops.

29. A locking apparatus for a surfboard comprising:

an adjustable loop formed of a material flexible along its entire length for extending about a surfboard, the loop positioned between fins extending from the surfboard and a wide middle portion of the surfboard;

a lock for fixing the size of the adjustable loop;

a tether strap interconnected with the adjustable loop; and a stopper interconnected with the tether strap;

wherein the tether strap is formed of an excess length of the flexible material that forms the adjustable loop.

30. The apparatus of claim 29 wherein the stopper rides on the tether and a rivet at the end of the tether retains the stopper on the tether.

* * * * *